US005556141A

United States Patent [19]

Rogers

[11] Patent Number: 5,556,141

[45] Date of Patent: Sep. 17, 1996

[54] CABINET DOOR LATCH

[76] Inventor: Charles Rogers, 9947 Wish Ave., Northridge, Calif. 91325

[21] Appl. No.: 526,998

[22] Filed: Sep. 12, 1995

[51] Int. Cl.[6] ..... E05C 19/10

[52] U.S. Cl. ..... 292/99; 292/303; 292/341.17

[58] Field of Search ..... 292/99, 102, 107, 292/303, 341.17

[56] References Cited

U.S. PATENT DOCUMENTS

| | | | |
|---|---|---|---|
| 1,368,048 | 2/1921 | Pilliod | 292/99 X |
| 1,516,692 | 11/1924 | Andreas | 292/107 X |
| 2,573,984 | 11/1951 | Parker et al. | 292/303 X |
| 4,139,249 | 2/1979 | Hillman | 312/333 |
| 4,191,411 | 3/1980 | Rodgers | 292/87 |
| 4,632,438 | 12/1986 | McKinney | 292/87 |
| 4,717,184 | 1/1988 | Boyce | 292/87 |
| 4,993,762 | 2/1991 | Rogers et al. | 292/303 |

FOREIGN PATENT DOCUMENTS

| | | | |
|---|---|---|---|
| 184895 | 9/1936 | Switzerland | 292/303 |
| 1824493 | 6/1993 | U.S.S.R. | 292/341.17 |

*Primary Examiner*—Rodney M. Lindsey
*Attorney, Agent, or Firm*—Joseph H. McGlynn

[57] ABSTRACT

A three-part cabinet latch, a first part of which is relatively rigid, is attached to the cabinet door and has a hook shaped portion on one end. Another part is relatively resilient, is attached to the cabinet floor and has a hook shaped end which cooperates with the hook shaped portion on the first part to hold the door closed. A third part of the cabinet latch is a quick- release pin installed through a hole in the cabinet floor, and when pushed up will force the resilient second part to release from the first part so the door can be opened.

4 Claims, 1 Drawing Sheet

CABINET DOOR LATCH

BACKGROUND OF THE INVENTION

This invention relates, in general, to a cabinet latch and, in particular, to a latch that will prevent the unwanted or inadvertent opening of a cabinet when items within the cabinet fall against the door, such as during an earthquake.

When a storage cabinet is overloaded with heavy, stacked items, i.e., canned goods, there is a tendency for the upper layers of cans to be dislodged and fall over, thereby causing a cabinet door with a conventional magnetic catch to fly open, discharging the contents of the cabinet over counters or floors, thus creating a safety hazard. The present invention is designed specifically to prevent this from happening.

DESCRIPTION OF THE PRIOR ART

In the prior art, there are various types of safety latches designed to limit access to certain materials. For example, U.S. Pat. No. 4,139,249 discloses a child proof latch having a spring biased latch mounted on an inaccessible inward facing surface of a closure panel. U.S. Pat. No. 4,191,411 discloses a safety latch for a cabinet having a resilient leaf portion. When the leaf portion is forced into engagement with an abutment it deflects and rotates into a latched position. U.S. Pat. No. 4,632,438 discloses a child proof safety latch which includes a base portion mounted on the door with a resilient hook which engages the cabinet. U.S. Pat. No. 4,717,184 discloses a child resistant latch having a hook portion which engages a loop on the cabinet to hold the drawer or door in a partially open position which prevents access to the drawer and prevents closing of the drawer or door to prevent a child's fingers from being injured.

The safety catches of the prior art are cumbersome to operate, particularly for one with arthritic fingers, a handicapped person with loss of muscle control, or one with short fingers. All of the prior art devices require a cabinet door or drawer to be partially opened and the fingers are used to push down on the latch. While prior art devices limit access, the present invention is designed to contain stored materials in a cabinet, while allowing ease of access to the contents of the cabinet.

SUMMARY OF THE INVENTION

The instant invention is a three-part cabinet latch, a first part of which is relatively rigid, is attached to the cabinet door and has a hook shaped portion on one end. Another part is relatively resilient, is attached to the cabinet floor and has a hook shaped end which cooperates with the hook shaped portion on the first part to hold the door closed. A third part of the cabinet latch is a quick- release pin installed through a hole in the cabinet floor, and when pushed up will force the resilient second part to release from the first part so the door can be opened. The latch is designed to be unobtrusive, easy to install, easy to open, yet strong enough to contain cabinet contents in earthquake prone areas.

These and other objects and advantages of the present invention will be fully apparent from the following description, when taken in combination with the annexed drawings.

DESCRIPTION OF THE PREFERRED EMBODIMENT

Figure 1:
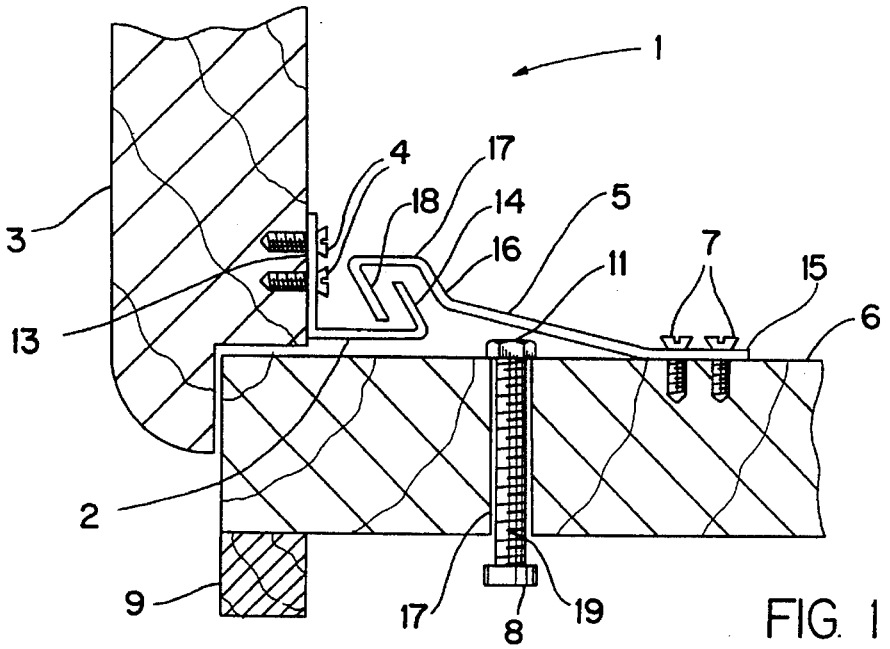
FIG. 1 is a cutaway view of the three-part cabinet latch shown mounted on an over-the counter cabinet.

Referring now to the drawings in greater detail, in FIG. 1 there is shown a cutaway view of an above-the counter cabinet to which the cabinet door latch 1 of the present invention is attached. A rigid latch hook is mounted on the cabinet door 3 by way of screws 4. The rigid latch hook has a straight portion 13, through which the screws 4 extent to secure the rigid latch hook to the inside of the cabinet door 3. Connected to the portion 13 is another straight portion 2 which is disposed at a right angel to portion 13. Connected to portion 2 is an angled portion 14 which is angled so it points back toward the inside of the cabinet door 3.

A resilient latch 5, 15, 16 and 17 is shown mounted on the cabinet floor 6 by way of screws 7. The precise positioning of rigid latch hook 2, 13 and 14 and resilient latch 5, 15, 16 and 17 may be made by the use of a template (not shown) for proper positioning of the screws 4 and 7. The resilient latch consists of a straight portion 15 through which the screws 7 extend to secure the resilient latch hook to the inside of the cabinet floor 6. The angular configuration of portion 18 of the rigid latch hook and portion 14 of the resilient latch allow for the cabinet door 3 to be securely closed until such time as one chooses to release the cabinet door 3 by way of the release pin 19.

Release pin 19 has a head 8 on one end and a removable head 11 on the other end. The head 11 may be made with an internal screw-threaded aperture 20, as shown in FIG. 3 which can be secured to the end 21 of pin 19 which has external screw threads. This will allow the pin to be inserted through aperture 12, as shown in FIGS. 1 and 2, in the floor of the cabinet and the head 11 attached to prevent the pin from falling back through the aperture 12.

The pin 19 can be unobtrusively installed through hole 12 behind the bottom lip 9 of an above-the-counter cabinet, as shown in FIG. 1 and is easily engaged by pressing a finger upward on release pin head 8. This will force portion 5 of the resilient latch upwards until hook portion 18 disengages from the hook portion 14 on the rigid latch. At this time the cabinet door can be opened.

Figure 2:
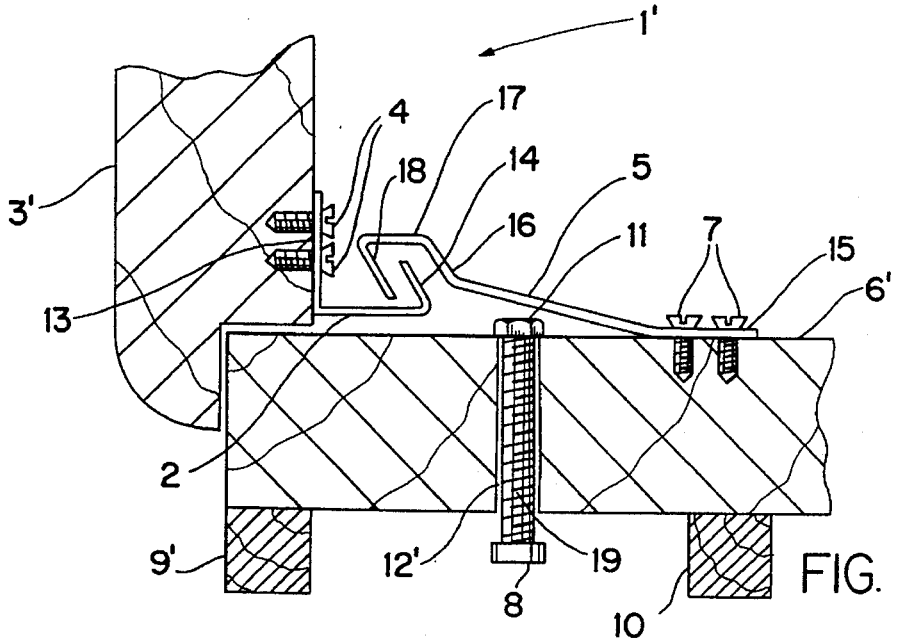
FIG. 2 is a cutaway view of the three-part cabinet latch mounted in a below-the-counter cabinet.
Figure 3:
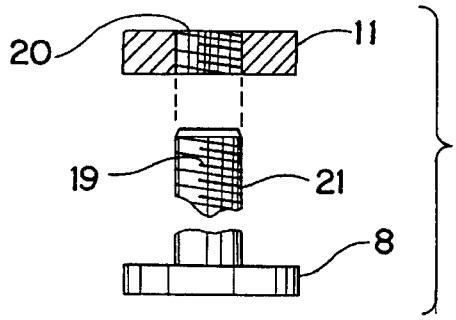
FIG. 3 is a view showing the nut and bolt configuration of the release pin.

FIG. 2 shows the use of the three-part latch on a below-the-counter cabinet. The rigid latch and the resilient latch are identical to those used in FIG. 1, and are mounted in the same manner. The only difference is where the release pin 19 is mounted. Since a below-the-counter cabinet has a kick-plate 10 which extends from beneath the cabinet floor to the floor of the room, the pin must be mounted in front of the kick-plate and behind the lip 9'. In all other respects the latch used on a below-the-counter cabinet is the same as the one used on an above-the-counter cabinet FIG. 3 shows the nut and bolt-type configuration used for release pin 19, which may be formed from, but not limited to, either metal or a material such as plastic. A hole 12 or 12' must be drilled through the cabinet floor 6 or 6', through which release pin 19 is passed in order to connect with bolt head 11 on the inside floor of the cabinet. When release pin 19 is engaged by pressing upward from beneath the cabinet floor, resilient latch portion 15 is raised, disengaging portion 18 from hook shaped portion 14 on the rigid latch. After which the door 3 or 3' may be easily opened.

Although the cabinet door latch and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A cabinet door latch for retaining a cabinet door closed comprising:

a rigid element mounted on the inside of said cabinet door, said rigid element having one end attached to said cabinet door and a free end, said free end having a hook-shaped portion, a resilient element having one end attached to a floor of a cabinet and a free end, said free end having a hook-shaped portion, said hook-shaped portions interengaging to maintain said cabinet door in a closed position, means extending through said floor of said cabinet for releasing said hook-shaped portions so said cabinet door may be opened.

2. The cabinet door latch as claimed in claim 1, wherein said rigid element is attached by means of screws to an inside portion of said cabinet door.

3. The cabinet door latch as claimed in claim 1, wherein said resilient element is attached by means of screws to said floor of said cabinet.

4. The cabinet door latch as claimed in claim 1, wherein said means for releasing said hook shaped portions is an elongated element which extends through an aperture in said floor of said cabinet, said elongated element having enlarged portions at opposite ends.

* * * * *